US006808295B2

(12) United States Patent
Waltz et al.

(10) Patent No.: US 6,808,295 B2
(45) Date of Patent: Oct. 26, 2004

(54) LIGHT MODIFIER MOUNTING ASSEMBLY

(75) Inventors: Thomas A. Waltz, Manitou Beach, MI (US); Kelly Mondora, Perrysburg, OH (US)

(73) Assignee: F. J. Westcott Company, Toledo, OH (US)

( * ) Notice: Subject to any disclaimer, the term of this patent is extended or adjusted under 35 U.S.C. 154(b) by 60 days.

(21) Appl. No.: 10/285,930

(22) Filed: Nov. 1, 2002

(65) Prior Publication Data

US 2003/0086272 A1 May 8, 2003

Related U.S. Application Data

(60) Provisional application No. 60/337,645, filed on Nov. 8, 2001.

(51) Int. Cl.[7] ..... F21V 1/08; F21V 17/06

(52) U.S. Cl. ..... 362/353; 362/434; 362/449

(58) Field of Search ..... 362/16–18, 351–353, 362/355–358, 360, 434–438, 440, 442, 443, 449

(56) References Cited

U.S. PATENT DOCUMENTS 1,178,764 A * 4/1916 Watanabe ..... 362/358
2,205,860 A * 6/1940 Olds ..... 362/17
2,975,270 A * 3/1961 Mayon ..... 362/358
4,446,506 A * 5/1984 Larson ..... 362/17
4,633,374 A 12/1986 Waltz et al.
4,656,568 A * 4/1987 Reed ..... 362/352
4,757,425 A 7/1988 Waltz
4,855,874 A 8/1989 Waltz
5,154,503 A 10/1992 Sternsher
5,311,409 A * 5/1994 King ..... 362/17
6,030,087 A * 2/2000 Whittle ..... 362/18

* cited by examiner

*Primary Examiner*—Alan Cariaso
(74) *Attorney, Agent, or Firm*—Emch, Schaffer, Schaub & Procello Co., L.P.A.

(57) ABSTRACT

A light modifier mounting assembly includes an outer frame which is rotatably connected to an interchangeable adapter ring. The adapter rings have different sizes of light openings. One of the adapter rings is mounted on the lighting fixture. A soft tent modifier includes a plurality of rods which define the shape of the tent. The ends of the rods are connected to the rotatable outer frame. The image maker may also rotate the light modifier during use without disassembly of the mounting assembly.

3 Claims, 7 Drawing Sheets

LIGHT MODIFIER MOUNTING ASSEMBLY

This application claims the benefit of Provisional Application No. 60/337,645 filed Nov. 8, 2001.

BACKGROUND OF THE INVENTION

Various types of light modifiers are known in the art. One example of a light modifier is disclosed in U.S. Pat. No. 5,154,503. One type of a light modifier is sometimes referred to as a "soft box". It consists of a tent-shaped box which fits in front of the lamp of a lighting fixture. The lighting modifier or soft box diffuses the light to obtain the image makers desired lighting effect. Often the tent-shaped box has a silver or white reflective surface inside so that the light is gathered and reflected towards the front. In some light modifier soft boxes, one or two layers of diffusion cloth are positioned towards the front end to spread and soften the light.

Non-moveable adapter rings for mounting a light modifier soft box to the lighting fixture are also known in the art. Adapter rings were designed for individual lighting fixtures, which varied in size.

An improvement was made in the prior art which consisted of an adjustable ring made for a film/video line of lights. This prior art ring had arms protruding outwardly to attach to the lighting fixture. The protruding arms also had the ability to be adjusted. This allowed the photographer to use the same ring with a number of different lighting fixtures. A disadvantage of this prior art adapter ring was that it did not rotate. If the photographer wants to quickly turn the light modifier soft box for a different lighting effect, it is necessary to remove the lighting modifier manually; turn the lighting modifier; and then reconnect it to the lighting fixture.

SUMMARY OF THE INVENTION

The present invention is directed to a light modifier mounting assembly which includes an adapter ring which is rotatably mounted to the lighting fixture. A spinning outer frame is rotatably mounted to the adapter ring and in turn mounts the lighting modifier soft box. The present invention allows the photographer to rotate the soft box at all times to obtain the desired lighting effect.

DETAILED DESCRIPTION OF THE PREFERRED EMBODIMENT

Figure 1:
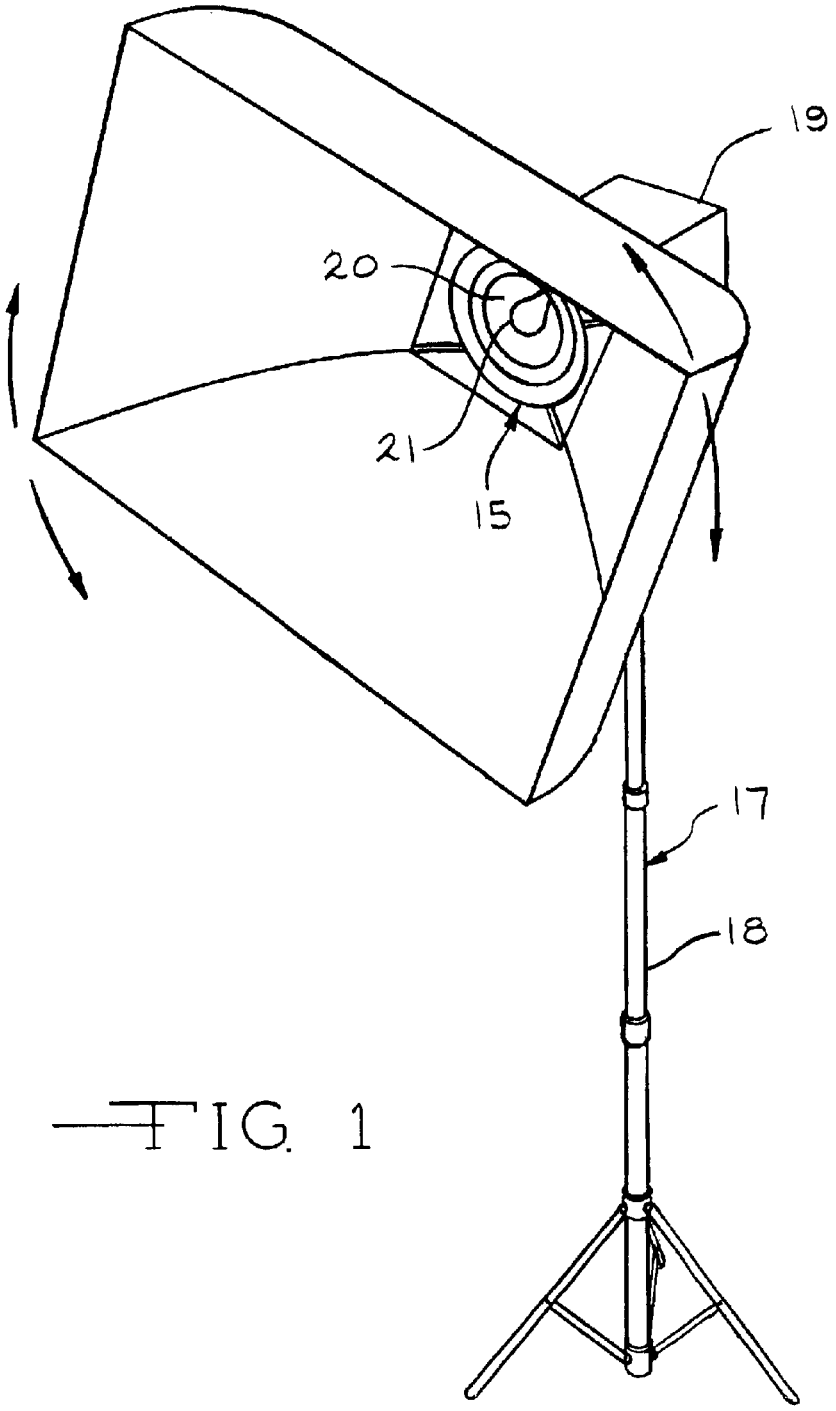
FIG. 1 is a perspective view of a lighting assembly which includes a light modifier mounting assembly.

Referring to FIG. 1, a light modifier mounting assembly is generally indicated by the reference number 15. The mounting assembly 15 is a part of a lighting assembly 17 including a stand 18 and a lighting fixture 19.

Figure 7:
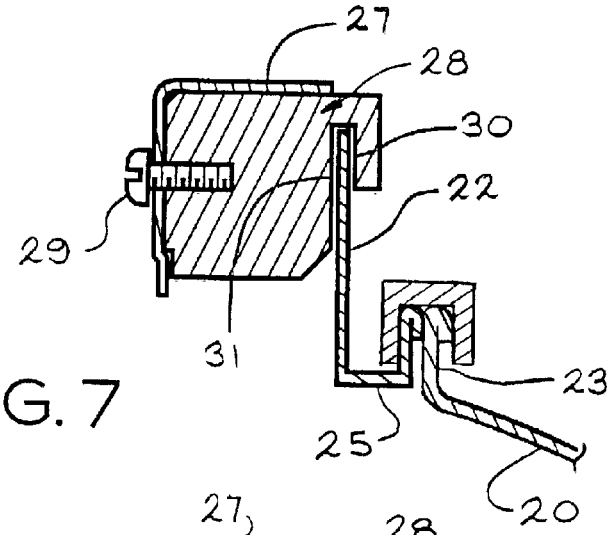
FIG. 7 is a fragmentary cross-sectional view taken along the line 7—7 of FIG. 3.

The lighting fixture 19 includes a generally conically shaped lamp housing 20 which receives a lamp 21. The photographic light modifier mounting assembly 15 includes an adapter ring 22. As best shown in FIG. 7, the adapter ring 22 is mounted on the edge 23 of the lamp housing 20.

Figure 8:
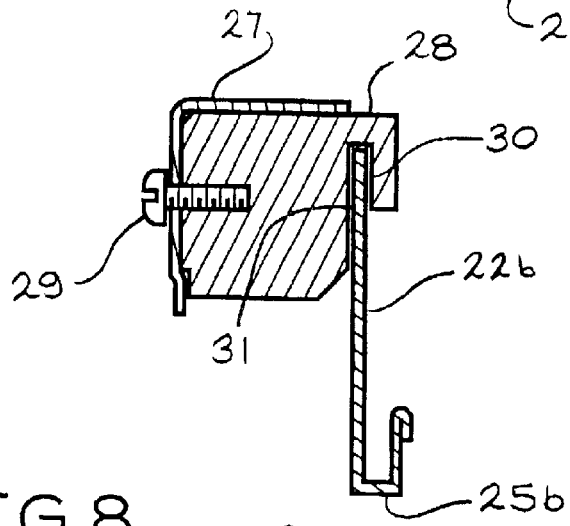
FIG. 8 is a view similar to FIG. 7 showing a different size adapter ring.
Figure 9:
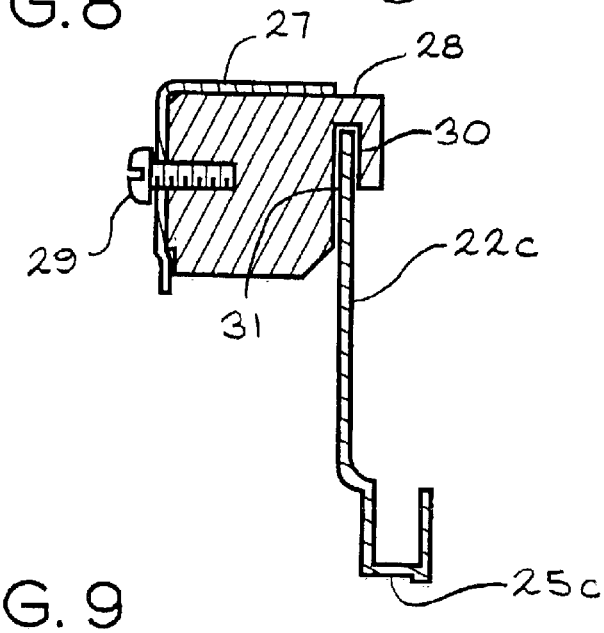
FIG. 9 is also a view similar to FIG. 7 showing a different size adapter ring.
Figure 10:
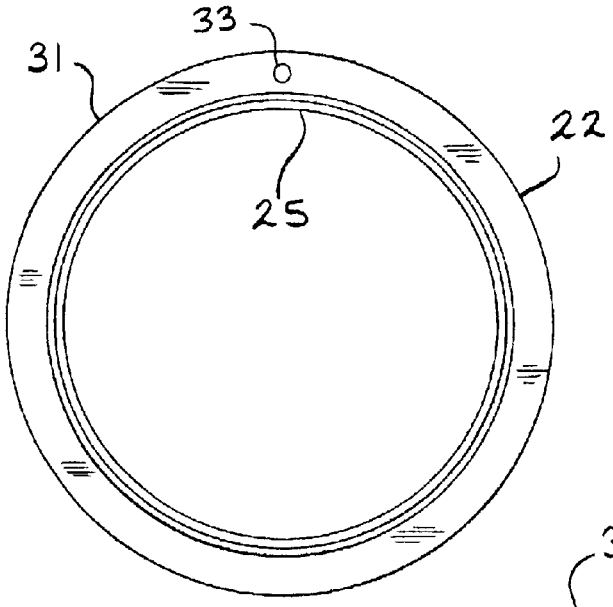
FIGS. 10, 11 and 12 are plan views showing different size adapter rings corresponding to the adapter rings shown in FIGS. 7–9.
Figure 12:
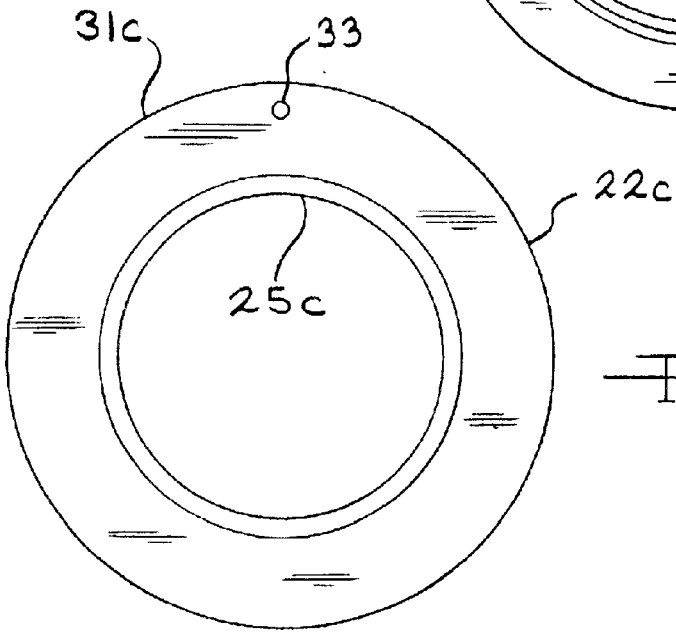

As shown in FIGS. 7 and 10, the adapter ring 22 is circular and defines a central circular opening 25. FIG. 8 shows another embodiment of an adapter ring 22*b* which defines a smaller central opening 25*b*. FIGS. 9 and 12 show a still further embodiment of an adapter ring 22*c*, which defines a still smaller central opening 25*c*.

The adapter ring 22 can be removed from the lamp housing 20 and replaced with an adapter ring having a different diameter central opening. For examples, the adapter rings 22*b* or 22*c* may be utilized. Each of the rings 22*b* and 22*c* has the smaller diameter central opening. This allows the image maker to quickly mount a light modifier 45 to different lighting fixtures using the same outer frame 27 of the light modifier mounting assembly 15 and one of the adapter rings 22, 22*b* or 22*c*.

Figure 11:
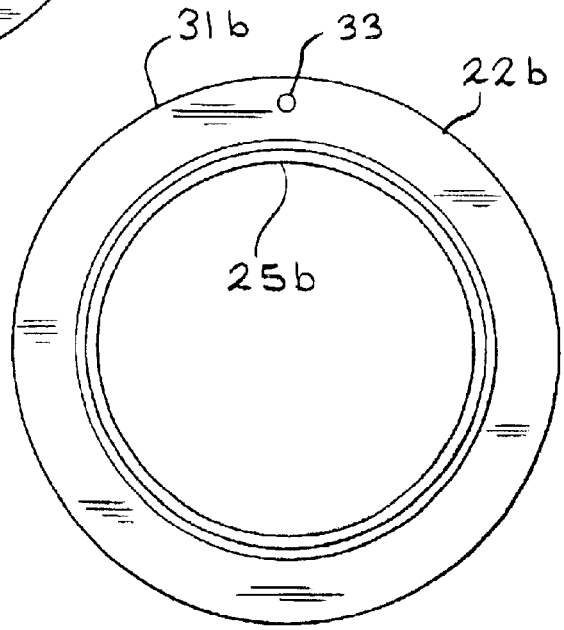

One feature of the present invention is a spinning outer frame 27 having at least one, and in the embodiment shown, plurality of mounting blocks 28 connected to the spinning outer frame 27 by a suitable fastener such as screws 29, as best seen in FIGS. 7–9. Each of the mounting blocks 28 defines a receiving groove 30 which receives the outer periphery 31, 31*b* and 31*c* of the respective adapter rings 22, 22*b* and 22*c*. The rings 22, 22*b* and 22*c* include openings 33, as best seen in FIGS. 10–12, which extend through the rings.

Figure 4:
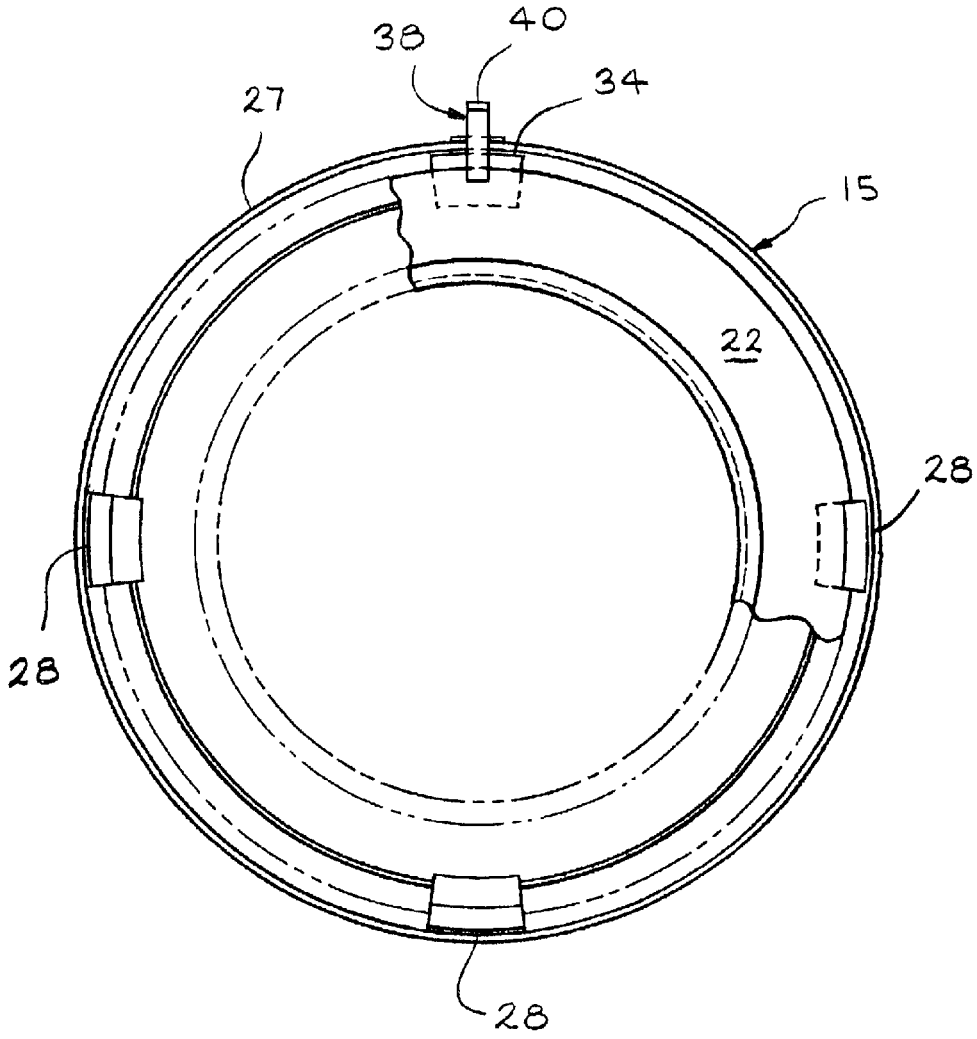
FIG. 4 is a fragmentary plan view, taken from the rear, showing the spinning outer frame mounted on the adapter ring of the light mounting assembly.
Figure 5:
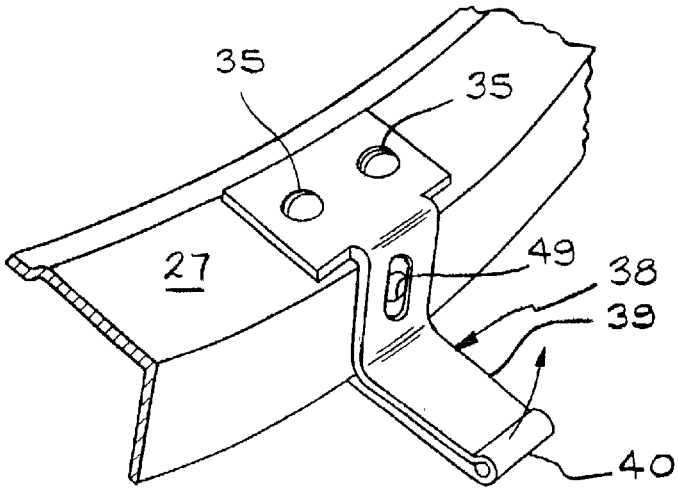
FIG. 5 is a fragmentary view showing a portion of the spinning outer frame and, particularly, a connector member.
Figure 6:
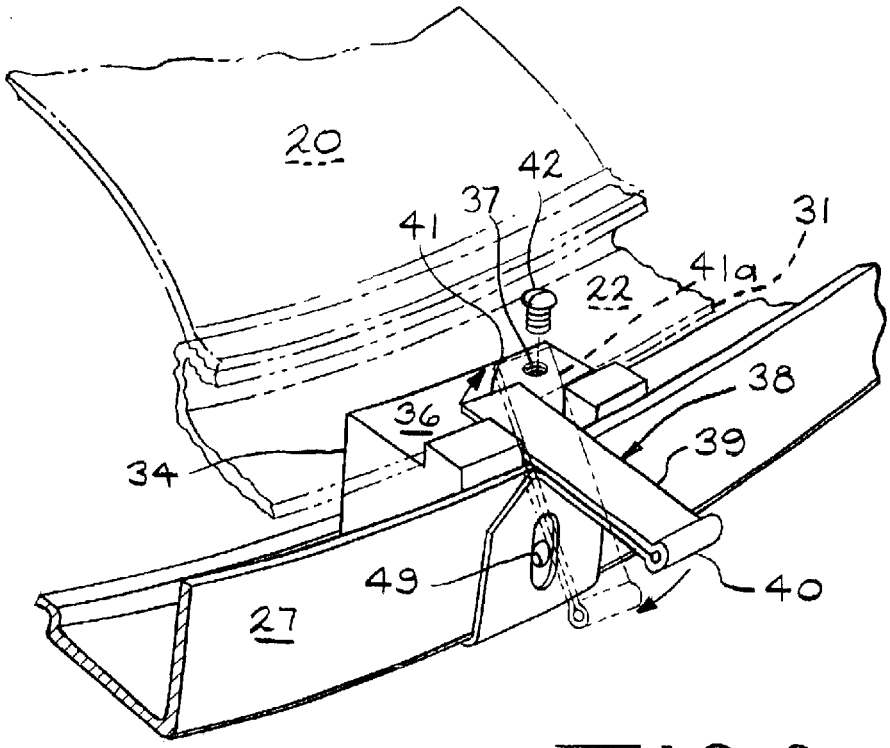
FIG. 6 is a view similar to FIG. 5 showing the reverse side and indicating a portion of the adapter ring and a portion of the lamp housing by dashed lines.

As best shown in FIGS. 4, 5 and 6, in addition to the mounting blocks 28, which are connected to the spinning outer frame 27, a modified mounting block 34 is provided. The modified mounting block 34 is connected to the spinning outer frame 27 by suitable fasteners, such as, for example, a pair of screws 35 and defines an L-shaped ledge 36 on its inner surface. The mounting block 34 defines an opening 37 which receives a locking screw 42. The locking screw 42 extends through the opening 37 and one of the openings 33 in the rings 22, 22*b* and 22*c* when rotation between the ring 22 and the outer frame 27 is not desired. A connector assembly 38 is mounted on the spinning outer frame 27 adjacent the modified mounting block 34. The connecting assembly 38 includes a spring biased leaf 39 having an outer end 40 and an inner end 41.

As shown in FIG. 6, the inner end 41 of the spring bias leaf 39 is moveable between a locked, or perpendicular, position to an open, or angled, position. In FIG. 6, the spring bias leaf 39 is shown in a perpendicular position to the spinning outer frame 27 (i.e., the solid line position). The spring bias leaf 39 receives the outer periphery of the adapter ring 22 and together with the remaining mounting blocks 28, rotatably mounts the spinning outer frame 27 to the adapter ring 22. The inner end 41 of the spring bias leaf 39 restricts the periphery 31 of the adapter ring 22 from moving axially away from the L-shaped ledge 36. When the outer end 40 of the spring bias leaf 39 is depressed, as indicated by the arrow in FIG. 6, the inner end 41 moves to an angled position (i.e., the dashed lined position 41*a*). This allows the outer periphery 31 of the adapter ring 22 to move axially away from the L-shaped ledge 36 so that the spinning outer frame 27 can be moved away from the adapter ring 22. This is necessary when, for example an alternative adapter ring 22*b* or 22*c* is connected to a different lamp housing 20.

Figure 2:
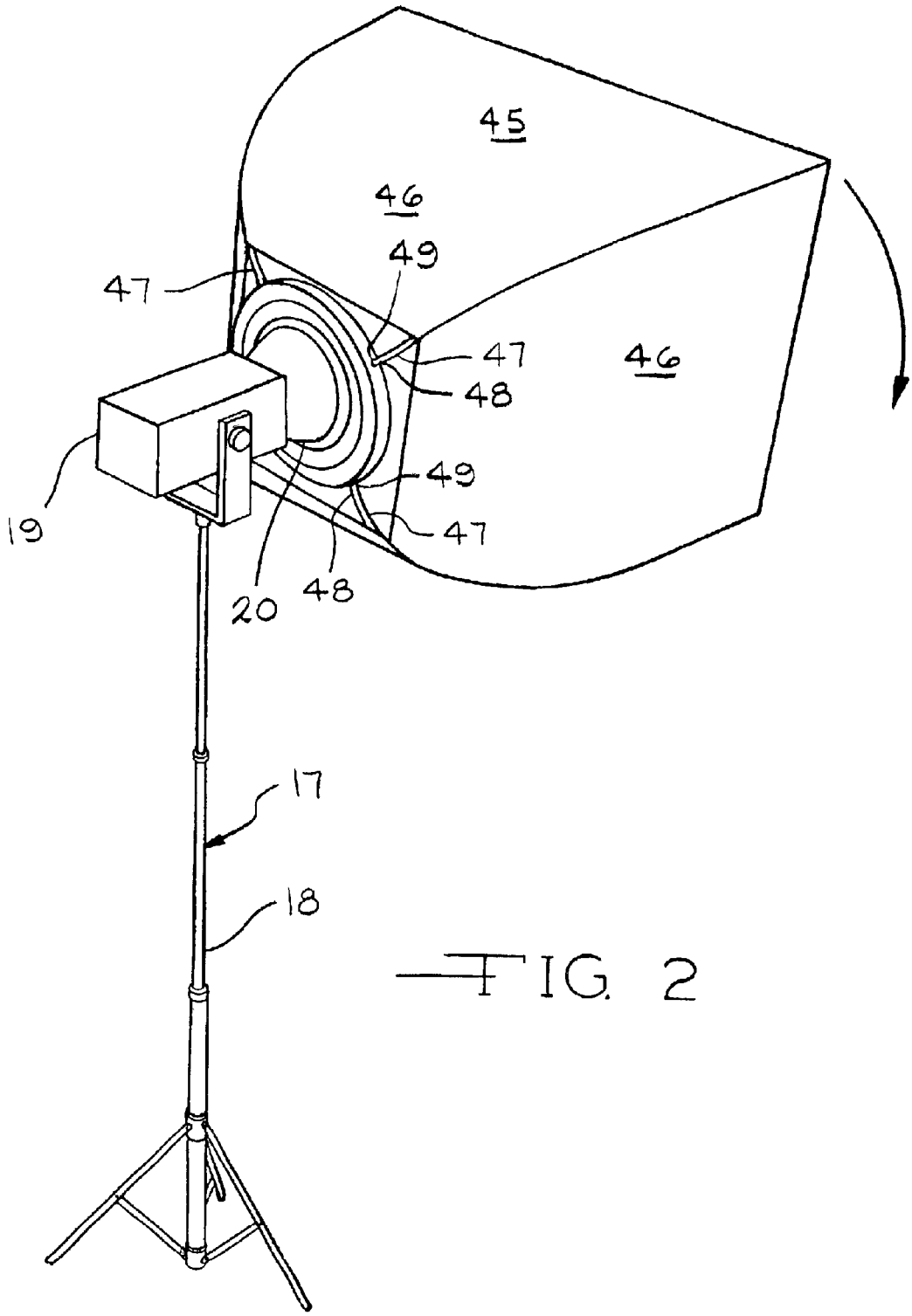
FIG. 2 is a perspective view showing the rear of the lighting assembly of FIG. 1.
Figure 3:
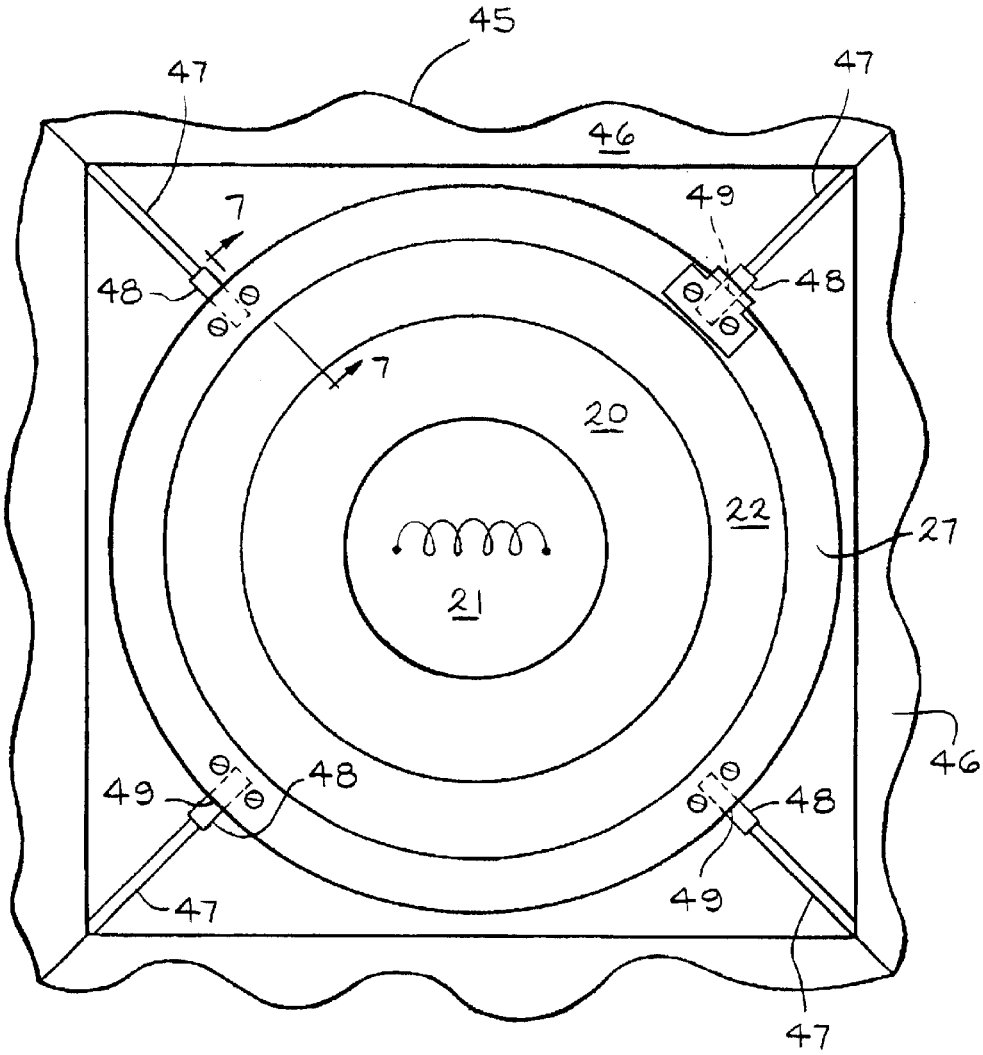
FIG. 3 is a plan view showing a light modifier mounting assembly mounted on the lighting fixture of a lighting assembly.

A light modifier 45 is mounted on the spinning outer frame 27. In the present embodiment, the light modifier 45 has a generally rectangular or circular (not shown) shape at its outer end and is a tent-like "soft box" structure. As indicated by the arrows in FIGS. 1 and 2, the light modifier 45 may be rotated by the photographer during use. While not shown in FIG. 1, it is common to have a diffuser fabric on the front of the rectangular light modifier 45. The light modifier 45 includes fabric walls 46 which are held in their desired positions by a plurality of rods 47. The rods 47 include ends 48 which are received in openings 49 defined in the outer periphery of the spinning outer frame 27.

The present invention provides for dual rotations of the light modifier 45. The first rotation occurs between the adapter ring 22 and the lamp housing 20. If the locking screw 42 is removed, a second rotation is also possible between the ring 22 and the outer frames 27.

Many modifications may be made to the above-described embodiment without departing from the scope of the present invention.

We claim:

1. A light modifier mounting assembly for use in a lighting assembly having a lamp housing, said light modifier mounting assembly including an outer frame, at least one interchangeable adapter ring for connection to the lamp housings, said circular outer frame being mounted for rotation on said interchangeable adapter ring, at least one mounting block connected to the outer frame by a suitable fastener, the mounting block defines a receiving groove which receives an outer periphery of the adapter ring;

a modified mounting block connected to the outer frame by at least one second fastener, the modified mounting block defining an L-shaped ledge on an inner surface and further defining opening which receives a locking screw whereby the locking screw extends through the opening in the modified mounting block and through at least one opening in the adapter ring when rotation between the adapter ring and the outer frame is not desired;

and the light modifier including a plurality of rods, said rods being removably mounted to said circular outer frame, whereby said light modifier can be rotated during use without disassembly of said light modifier mounting assembly.

2. The light modifier mounting assembly of claim 1 further including a connector assembly mounted on the outer frame adjacent a modified mounting block, the connecting assembly including a spring bias leaf having an outer end and an inner end, the spring leaf being moveable between a locked position and an open position.

3. The light modifier mounting assembly of claim 2 wherein the spring bias leaf is in a locked position when the inner end of the spring-biased leaf is in a perpendicular position with respect to the connector assembly.

* * * * *